United States Patent [19]

Feldmann et al.

[11] Patent Number: 4,519,233

[45] **Date of Patent: * May 28, 1985**

[54] ROLL STAND WITH NONCYLINDRICAL ROLLS

[75] Inventors: Hugo Feldmann, Alsdorf; Friedrich Hollmann, Grevenbroich; Gerd Beisemann, Düsseldorf; Horst Gärtner, Neuss, all of Fed. Rep. of Germany

[73] Assignee: SMS Schloemann-Siemag AG, Düsseldorf, Fed. Rep. of Germany

[ * ] Notice: The portion of the term of this patent subsequent to Apr. 3, 2001 has been disclaimed.

[21] Appl. No.: 483,372

[22] Filed: Apr. 8, 1983

[30] Foreign Application Priority Data

Oct. 15, 1980 [DE] Fed. Rep. of Germany ..... 3038865
Apr. 10, 1982 [DE] Fed. Rep. of Germany ..... 3213496

[51] Int. Cl.[3] ..... B21B 31/18
[52] U.S. Cl. ..... 72/247; 72/241
[58] Field of Search ..... 72/177, 179, 240, 241, 72/243, 247, 201

[56] References Cited

U.S. PATENT DOCUMENTS 1,895,607 1/1933 Coe ..... 72/241
3,943,742 3/1976 Kajiwara et al. ..... 72/247
4,440,012 4/1984 Feldmann et al. ..... 72/201

FOREIGN PATENT DOCUMENTS 1452153 12/1968 Fed. Rep. of Germany .
2260256 6/1973 Fed. Rep. of Germany .
2919105 11/1979 Fed. Rep. of Germany .
72746 6/1979 Japan ..... 72/243
100960 8/1979 Japan ..... 72/241

*Primary Examiner*—Lowell A. Larson
*Assistant Examiner*—Jorji M. Griffin
*Attorney, Agent, or Firm*—Karl F. Ross; Herbert Dubno

[57] ABSTRACT

A rolling stand comprises a housing defining a pair of parallel and spaced inner axes and a pair of parallel and spaced outer axes flanking the inner axes and defining therewith a plane. Respective inner rolls are journaled in the housing at the inner axes and have bodies axially symmetrical about the respective axes and having centered on the respective axes roll-body surfaces of noncylindrical shape and each formed by rotation of a continuously curved generatrix about the respective axis. One of the inner rolls is displaceable axially relative to the other inner roll from an end position to another position. The inner-roll surfaces are spaced in the plane in the other position at a uniform distance and in the plane in the end position at a nonuniform distance. Respective outer rolls journaled in the housing at the outer axes bear toward each other on the respective inner rolls. The outer rolls have roll bodies axially symmetrical about the respective axes and having centered on the respective axes roll-body surfaces of noncylindrical shape complementary to that of the respective inner roll. At least one of the rolls of one of the pairs can be displaced axially relative to one of the rolls of the other pair.

8 Claims, 4 Drawing Figures

ROLL STAND WITH NONCYLINDRICAL ROLLS

CROSS REFERENCE TO RELATED APPLICATION

This application is related to copending patent application Ser. No. 311,449 filed Nov. 24, 1981 by ourselves and others.

FIELD OF THE INVENTION

The present invention relates to a roll stand. More particularly this invention concerns a roll stand having noncylindrical and axially displaceable rolls.

BACKGROUND OF THE INVENTION

German patent document No. 2,919,105 filed by R. Verbickas et al with a claim to the priority of U.S. application Ser. No. 907,502 filed May 19, 1978, now abandoned and U.S. Pat. Nos. 2,776,586 and 3,857,268 describe the use of working rolls of noncylindrical shape in a roll stand, and the provision of means for displacing at least one of these rolls axially relative to the other and for bending at least one of these rolls. In this manner it is possible to change the dimension of the gap or so-called nip formed between the two rolls.

The bending equipment for the roll adds considerably to the cost of the rolling stand. On the one hand it is necessary to provide roll-bending devices that bend the ends of the roll away from the nip, so-called positive bending, and separate equipment for bending of the ends of the roll toward the nip, so-called negative bending. Positive bending increases the pressure at the longitudinal edges of a workpiece being rolled and negative bending decreases this pressure, for corresponding decreases and increases in workpiece thickness at these edges.

It is possible to achieve only minimal variations in nip dimensions without this bending equipment. That is, without using the bending equipment it is impossible to achieve anything other than slight variations in a workpiece with longitudinal edges thicker than its middle.

Not only is this type of arrangement quite expensive, but accurately establishing the proper amount of bend in conjunction with the right axial position of the working roll is very difficult, requiring expert setup personnel and frequent monitoring during operation to verify that the system remains properly set up. What is more, when positive bending is employed it is necessary to exert enormous forces against the working-roll ends, so that the roll-stand housing must be overdimensioned considerably.

In the copending application cross referred to above a roll stand is described having a conventional housing defining a pair of parallel and spaced axes defining a plane. Respective rolls have roll ends journaled in the housing at the axes and roll bodies axially symmetrical about the respective axes and having centered on the respective axes complementary roll-body surfaces of noncylindrical shape and each formed by rotation of a continuously curved generatrix about the respective axis. One of these contoured rolls is displaceable axially relative to the other roll from an end position to another position, and the roll-body surfaces form at the plane in the other position a uniform nip and in the end position a nonuniform nip. Finally the system has means for displacing one of the rolls axially relative to the other of the rolls between the end position and the other position. These contoured rolls may themselves define the nip, or may engage and deform other rolls that define it.

With this arrangement therefore the shape of the roll-body surfaces—wholly contoured with no cylindrical portions—allows the nip to be adjusted solely by axial displacement of one of the rolls relative to the other. In addition the shape of the nip and the corresponding cross section of the workpiece is varied by relatively minor shifting of the contoured roll, with no effect on the overall nip width. Thus the workpiece cross section can be changed without having to readjust for a different workpiece width.

According to a feature of this earlier invention the roll bodies are of identical shape but the one roll is reversed 180° relative to the other roll. This is achieved most advantageously when the surfaces each have one half of outwardly convex shape and another half of outwardly concave shape. In such an arrangement it is possible for the nip to be set to impart to the workpiece a cross section of uniform thickness, of greater thickness at the outer longitudinal edges, or of greater thickness at the center. Regular and stepless variation from the one shape to the other can be easily achieved and will surely remain set in the apparatus. Even a relatively unskilled person can set up the rolling stand according to this invention to achieve the exact shape desired.

The system of this earlier invention works extremely well, but is susceptible of improvement.

OBJECTS OF THE INVENTION

It is therefore an object of the present invention to provide an improved roll stand.

Another object is to advance the principles of the above-cited copending patent application.

SUMMARY OF THE INVENTION

These objects are attained according to the instant invention in a rolling stand comprising a housing defining a pair of parallel and spaced inner axes and a pair of parallel and spaced outer axes flanking the inner axes and defining therewith a plane. Respective inner rolls are journaled in the housing at the inner axes and have bodies axially symmetrical about the respective axes and having centered on the respective axes roll-body surfaces of noncylindrical shape and each formed by rotation of a continuously curved generatrix about the respective axis. One of the inner rolls is displaceable axially relative to the other inner roll from an end position to another position. The inner-roll surfaces are spaced in the plane in the other position at a uniform distance and in the plane in the end position at a nonuniform distance. Respective outer rolls journaled in the housing at the outer axes bear toward each other on the respective inner rolls. The outer rolls have roll bodies axially symmetrical about the respective axes and having centered on the respective axes roll-body surfaces of noncylindrical shape complementary to that of the respective inner roll. At least one of the rolls of one of the pairs can be displaced axially relative to one of the rolls of the other pair.

The inner rolls of the instant invention are directly juxtaposed and form a nip in which a workpiece is squeezed. In addition the roll bodies are of identical shape but each roll is reversed 180° relative to the adjacent roll. The surfaces each have one half of outwardly convex shape and another half of outwardly concave shape.

It is also possible according to this invention to employ, in a six-high arrangement, a second pair of inner rolls journaled in the housing at axes coplanar with, parallel to, and between the inner axes and having bodies axially symmetrical about the respective axes and having centered on the respective axes roll-body surfaces of generally cylindrical shape. The first inner rolls radially engage and deform the second inner rolls.

In another six-high system of this invention a second pair of outer rolls journaled in the housing at axes coplanar with, parallel to, and flanking the outer axes have bodies axially symmetrical about the respective axes and having centered on the respective axes roll-body surfaces of generally cylindrical shape. The second outer rolls radially engage and deform the first outer rolls.

DESCRIPTION OF THE DRAWING

The above and other features and advantages will become more readily apparent from the following, reference being made to the accompanying drawing in which.

SPECIFIC DESCRIPTION

Figure 1:
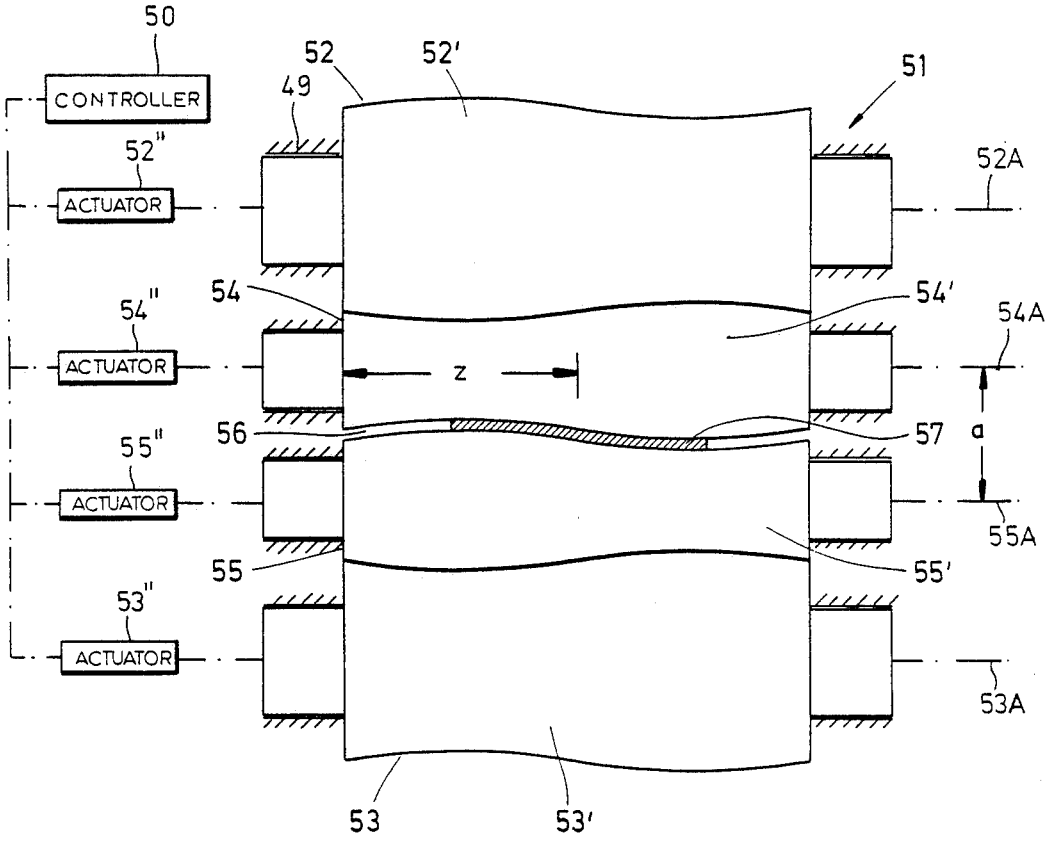
FIG. 1 is a partly diagrammatic end view of a four-high rolling stand according to the invention.

As seen in FIG. 1, a four-high rolling stand 51 has a housing or frame 49 in which two large-diameter backing rolls 52 and 53 are journaled at respective axes 52A and 53A. Small-diameter working rolls 54 and 55 are journaled in the frame 49 about respective axes 54A and 55A between and vertically coplanar with the axes 52A and 53A. These rolls 54 and 55 form a gap or nip 56 for a workpiece 57, here a steel strip being rolled. The rolls 55—55 can be shifted axially by respective actuators 52''–55'' operated by a common controller 50.

The rolls 52–55 have bodies 52'–55' shaped as described in the above-cited patent application, that is each formed by rotation of a wholly curved generatrix, here flatly S-shaped, about the respective axis. The bodies therefore each have an outwardly convex half and an outwardly concave half. These shapes are complementary and alternate in the illustrated positions.

As shown in FIG. 1 if the two rolls 54 and 55 are aligned with their complementary roll-body surfaces directly opposite each other and their axes 54A and 55A parallel and at a spacing a, the workpiece 57 will be rolled to uniform thickness, albeit of slight S-shape. The nip 56 is at any location along the axes of a height h determined by the formula:

$$h=a-r_{54}-r_{55},$$

with $r_{54}$ and $r_{55}$ being the radii of the rolls 54 and 55 taken at the axial location in question.

So long as the rolls are all perfectly complementarily aligned as illustrated in FIG. 1 the spacing h will be uniform. When a roll is shifted, this spacing h varies along the nip 56. The two rolls on one side of the nip 56 are shifted axially and jointly to achieve this effect. In this manner it is possible to increase or decrease the compression of the outer edges of the workpiece 57.

It is also possible to shift either of the working rolls 54 or 55 relative to the respective backing roll 52 or 53. Such adjustment allows one to make a very accurate adjustment of the nip 56.

Figure 2:
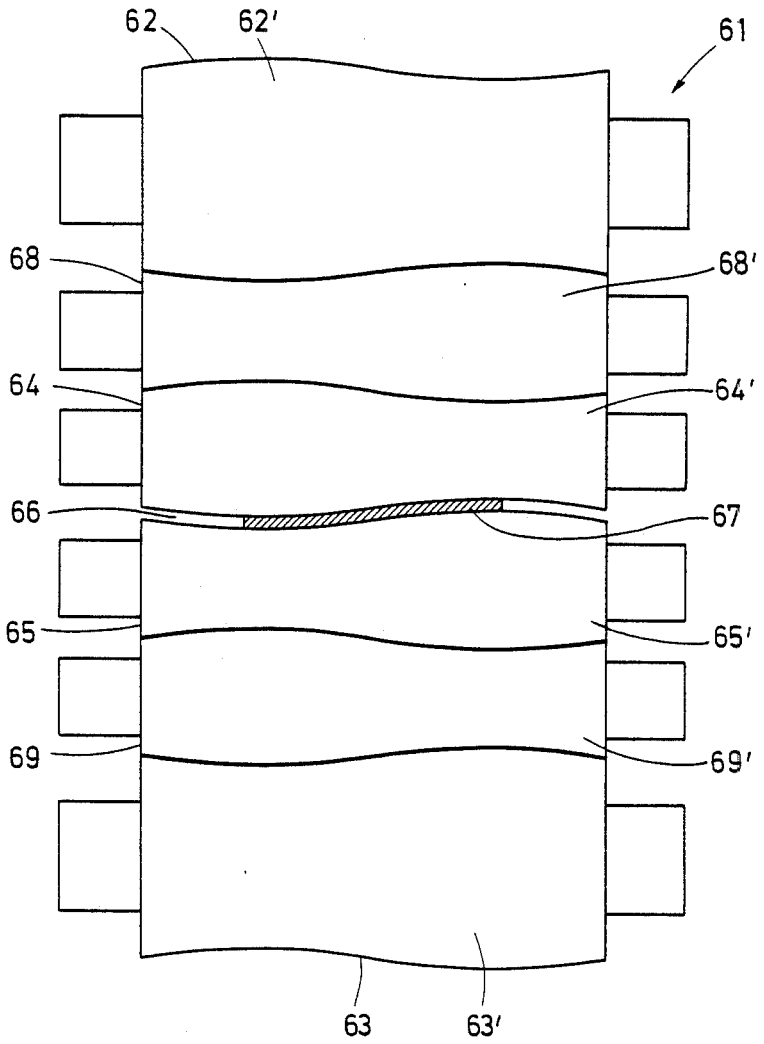
FIG. 2 is an end view of a six-high rolling stand according to the invention.

FIG. 2 shows a six-high roll stand 61 having large-diameter outer backing rolls 62 and 63, small-diameter inner working rolls 64 and 65 defining a gap 66 for a workpiece 67. Small-diameter intermediate rolls 68 and 69 rotatable about axes coplanar with those of the rolls 62–65 are braced between the outer rolls 62 and 63 and the respective inner rolls 64 and 65. These rolls 62, 63, 64, 65, 68, and 69 have bodies 62', 63', 64',65',68', and 69' shaped as described above with reference to FIG. 1.

In this arrangement extremely fine control over the nip 66 is obtained, since there are six different rolls to move and adjust with.

Figure 3:
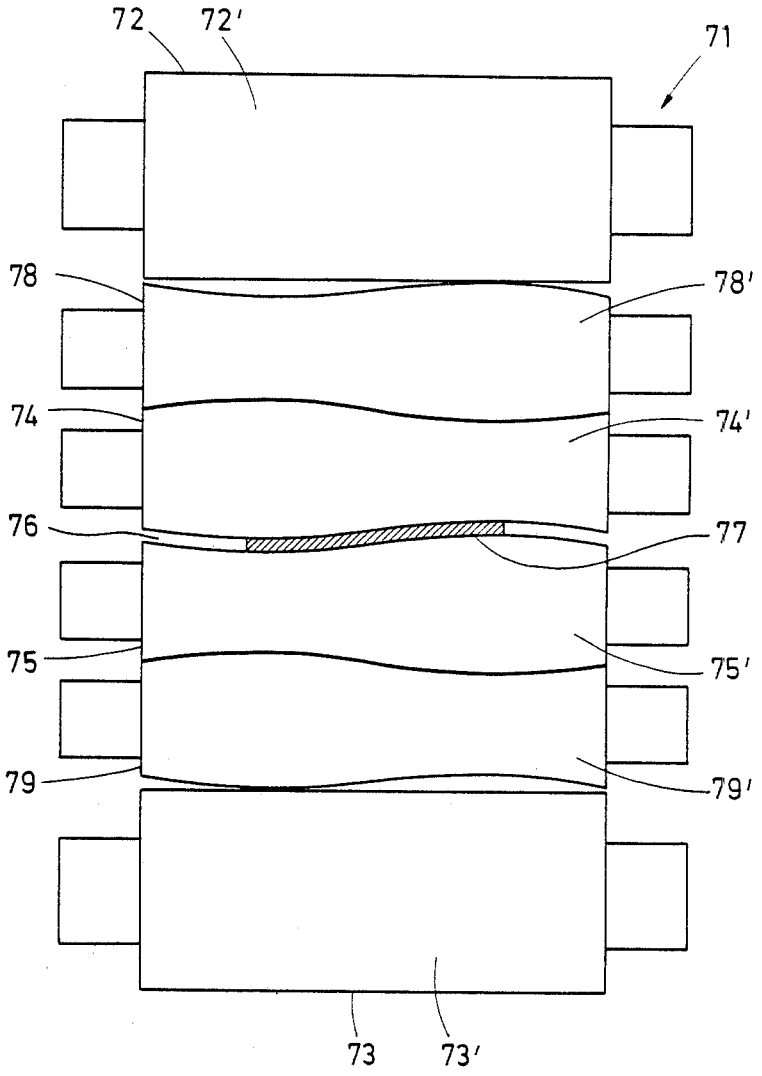
FIG. 3 is a view like FIG. 2 of a variation on the six-high stand of FIG. 2.

The arrangement of FIG. 3 is a six-high roll stand 71 having large-diameter outer backing rolls 72 and 73, small-diameter inner working rolls 74 and 75 difining a gap 76 for a workpiece 77, and small-diameter intermediate rolls 78 and 79 rotatable about axes coplanar with those of the rolls 72–75 and braced between the outer rolls 72 and 73 and the respective inner rolls 74 and 75. The rolls 74, 75, 78, and 79 have bodies 74', 75', 78', and 79' shaped as described above with reference to FIG. 1. The rolls 72 and 73, however, have cylindrical bodies 72' and 73' and are not axially displaceable. This system is therefore of the same adjustability as that of FIG. 1, but it costs somewhat less to build than the arrangement of FIG. 2 while being capable of exerting greater force than the FIG. 1 arrangement.

Figure 4:
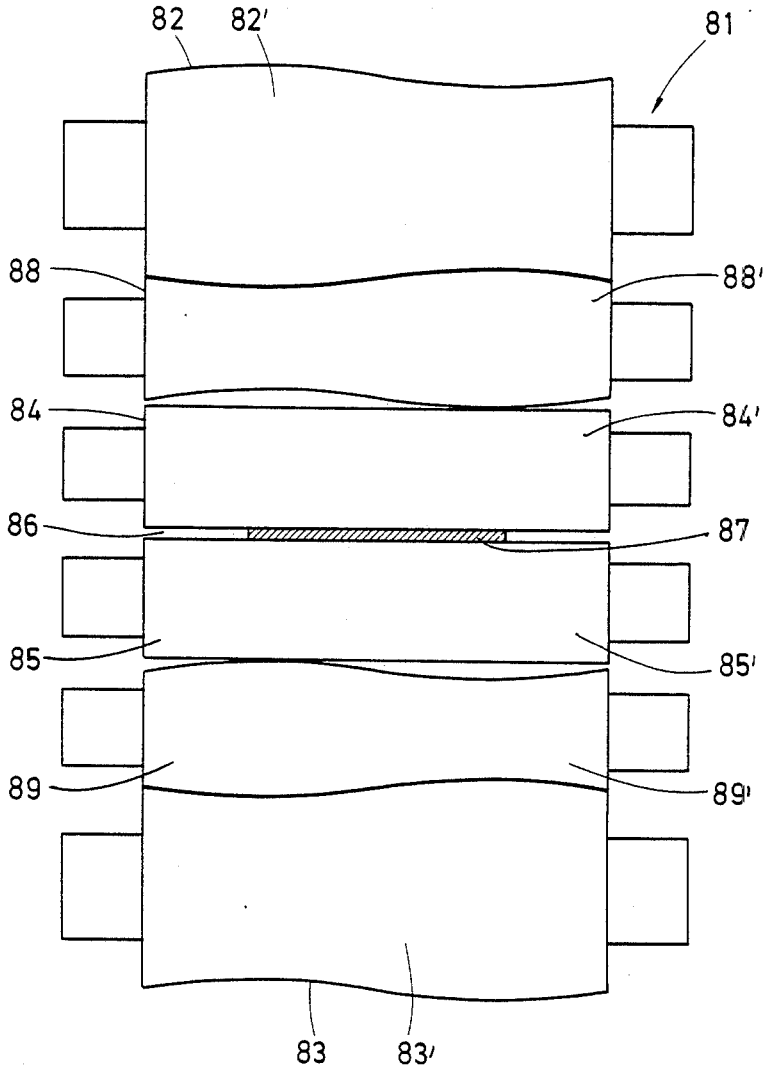
FIG. 4 is a view like FIG. 2 of another variation on the six-high stand.

In FIG. 4 a six-high roll stand 81 has large-diameter outer backing rolls 82 and 83, small-diameter inner working rolls 84 and 85 defining a gap 87 for a workpiece 87, and small-diameter intermediate rolls 88 and 89 rotatable about axes coplanar with those of the rolls 82–85 braced between the outer rolls 82 and 83 and the respective inner rolls 84 and 85. The rolls 82, 83, 88, and 89 have bodies 82', 83', 88', and 89' shaped as described above with reference to FIG. 1. The rolls 84 and 85, however, have cylindrical bodies 84' and 85' and are not axially displaceable. In this arrangement it is therefore possible to use low-cost cylindrical rolls as the working rolls which are the most likely to wear, thereby substantially cutting refitting costs for the machine.

The rolls 72 and 73 as well as the rolls 82 and 83 could be somewhat barrel-shaped, which shape is here meant by the term "generally cylindrical." In practice such barrel shapes flatten out on the workpiece engaging side somewhat.

The shape of the rolls can be milled right into them, so that the roll surfaces are of the defined shapes at ambient temperature. Thus the desired shape is simply machined into the contoured roll. It is also possible to use a roll that has at ambient temperature a roll body of cylindrical surface, and to provide means for differentially thermally influencing axially offset regions of the roll bodies for imparting the respective shapes thereto. Such means, as described in German patent document No. 2,908,641 based on a Dutch application filed Mar. 6, 1978 by H. K. Qûere and A. J. Tychon, normally includes a plurality of axially offset nozzles individually controllable for directing cold-liquid sprays at the respective regions of the roll. Those regions that are most heavily chilled will be of smaller diameter and, therefore, outwardly concave, and those which are allowed to run hot, as the rolls normally do, will be of greater diameter. The cold liquid is normally an oil/water/detergent emulsion used for flood lubrication of the rolls, and normally has a temperature of 20° C.–50° C.

The system according to this invention can be combined with virtually any standard rolling arrangement, such as systems for controlling strip thickness, systems for tipping one of the rolls, thermal-treatment arrangements, bend-straighteners, and the like. It is even possible to combine the inventive system with a roll-bending arrangement such as in the prior-art such devices to even more widely expand the versatility of the inventive system.

We claim:

1. A rolling stand comprising:

a housing defining a pair of parallel and spaced inner axes and a pair of parallel and spaced outer axes flanking the inner axes and defining therewith a plane;

respective inner rolls journaled in the housing at the inner axes and having bodies axially symmetrical about the respective axes and having centered on the respective axes roll-body surfaces of noncylindrical shape and each formed by rotation of a continuously curved generatrix about the respective axis, one of the inner rolls being displaceable axially relative to the other inner roll from an end position to another position, the inner-roll surfaces being spaced in the plane in the other position at a uniform distance and in the plane in the end position at a nonuniform distance;

respective outer rolls journaled in the housing at the outer axes and bearing toward each other on the respective inner rolls, the outer rolls having roll bodies axially symmetrical about the respective axes and having centered on the respective axes roll-body surfaces of noncylindrical shape complementary to that of the respective inner roll; and means for displacing at least one of the rolls of one of the pairs axially relative to one of the rolls of the other pair.

2. The rolling stand defined in claim 1 wherein the inner rolls are directly juxtaposed and form a nip in which a workpiece is squeezed.

3. The rolling stand defined in claim 2 wherein the roll bodies are of identical shape but each roll is reversed 180° relative to the adjacent roll.

4. The rolling stand defined in claim 2 wherein the surfaces each have one half of outwardly convex shape and another half of outwardly concave shape.

5. The rolling stand defined in claim 1, further comprising:

a second pair of inner rolls journaled in the housing at axes coplanar with, parallel to, and between the inner axes and having bodies axially symmetrical about the respective axes and having centered on the respective axes roll-body surfaces of generally cylindrical shape, the first inner rolls radially engaging and deforming the second inner rolls.

6. The rolling stand defined in claim 5 wherein the second rolls are axially nondisplaceable in the housing.

7. The rolling stand defined in claim 1, further comprising:

a second pair of outer rolls journaled in the housing at axes coplanar with, parallel to, and flanking the outer axes and having bodies axially symmetrical about the respective axes and having centered on the respective axes roll-body surfaces of generally cylindrical shape, the second outer rolls radially engaging and deforming the first outer rolls.

8. The rolling stand defined in claim 5 wherein the second rolls are axially nondisplaceable in the housing.

* * * * *